United States Patent [19]

Miller

[11] 4,213,224

[45] Jul. 22, 1980

[54] BY-PASS TYPE PORTABLE VACUUM CLEANER

[75] Inventor: Jonathan Miller, Williamsport, Pa.

[73] Assignee: Shop-Vac Corporation, Williamsport, Pa.

[21] Appl. No.: 935,265

[22] Filed: Aug. 21, 1978

[51] Int. Cl.[2] ..... A47L 5/24

[52] U.S. Cl. ..... 15/344; 15/413

[58] Field of Search ..... 15/344, 347, 413

[56] References Cited

U.S. PATENT DOCUMENTS

| | | | |
|---|---|---|---|
| 2,729,303 | 1/1956 | McMahan | 15/344 X |
| 3,477,087 | 11/1969 | Robinson | 15/344 |
| 3,484,890 | 12/1969 | Case | 15/413 X |

FOREIGN PATENT DOCUMENTS

| | | | |
|---|---|---|---|
| 246238 | 9/1947 | Switzerland | 15/344 |
| 738479 | 10/1955 | United Kingdom | 15/344 |

*Primary Examiner*—Christopher K. Moore

*Attorney, Agent, or Firm*—Ostrolenk, Faber, Gerb & Soffen

[57] ABSTRACT

A portable vacuum cleaner with a bypass fan arrangement: the main fan draws air into the vacuum cleaner housing axially and discharges it radially from the housing; a plenum chamber receives the air from the housing outlet and redirects the outlet air in a direction away from the housing inlet; the motor for the main fan is cooled by a motor cooling fan drawing air over the motor from the end of the motor housing opposite its inlet end; the main air flow and cooling air flows being separate; the housing is shaped internally to assure the separation of air flows just described.

6 Claims, 3 Drawing Figures

BY-PASS TYPE PORTABLE VACUUM CLEANER

The present invention relates to a vacuum cleaner and more particularly to a by-pass vacuum cleaner, which is simple in construction, easy to operate, to clean and reassemble after cleaning and which introduces a collected material by-pass arrangement which by-passes the collected material past the vacuum cleaner motor and thereby helps to prevent explosion of the collected material.

BACKGROUND OF THE INVENTION

Heretofore in the operation of electric vacuum cleaners, especially where the vacuum cleaner was a small one and intended to be hand held and, therefore, operated in close quarters, a flow through motor was utilized. In such a vacuum cleaner, the flow of air is substantially axial, starting at the forward end of the motor housing, through filtering means, going past the motor and then out through a vent at the rear of the motor housing.

However, some hand held vacuum cleaners are used to pick up material which is explosive in quality. The passage of contaminated air, even after it has been filtered, past the vacuum cleaner motor may create difficulties especially where the motor produces sparks, as frequently occurs at the brush contacts of the motor.

Thus, for instance, during the vacuum cleaning of excess toner from an electrostatic reproduction apparatus, there is danger because the toner is extremely explosive. It is important that the air stream in the vacuum cleaner, which is contaminated with particulate material, not pass over or through the vacuum cleaner motor itself.

SUMMARY OF THE INVENTION

According to the invention, to prevent the contaminated air flow from passing through or over the motor of the vacuum cleaner, a by-pass motor arrangement is used, wherein the contaminated air follows a pathway through the vacuum cleaner that leads it away from the motor thereof. Furthermore, since the vacuum cleaner may be hand held, the arrangement of by-pass air flow which by-passes the motor should be such that it does not increase the weight of the vacuum cleaner. Furthermore, even though the vacuum cleaner may be hand held, it is arranged so that a hose may be connected thereto and the vacuum cleaner left on the floor.

Thus, the primary object of the present invention is the formation of a portable light weight vacuum cleaner in which the air stream entering the vacuum cleaner is by-passed around the motor while at the same time it is appropriately filtered, and, because of the by-pass around the motor, air intakes which are potentially explosive may be treated without danger.

BRIEF DESCRIPTION OF THE DRAWINGS

The foregoing and other objects of the present invention will become apparent in the following description and drawings in which.

DESCRIPTION OF A PREFERRED EMBODIMENT

Figure 1:
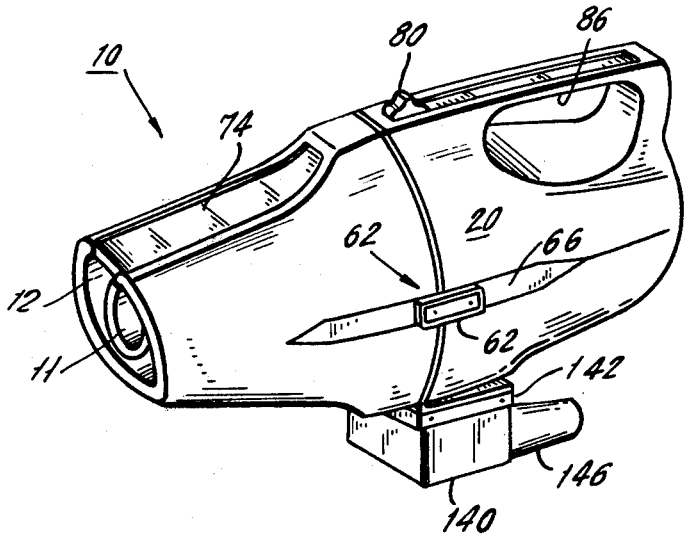
FIG. 1 is a view in perspective of a vacuum cleaner according to the present invention.

Referring now to the Figures, the type of vacuum cleaner 10 illustrated in the drawings is that shown generally in U.S. Design Pat. No. Des. 215,874 which, however, does not contain a by-pass arrangement according to the invention.

Air contaminated with particulate matter, or the like, enters through the opening 11 at the front of the vacuum cleaner 10. The opening 11 is arranged in any conventional manner so it may optionally receive a hose attachment (not shown) which enables the vacuum cleaner to stand on the floor. From opening 11, the air enters the front housing 12. The hose opening 11 is defined by a ring 13 which is supported at the front of front housing 12 and carries the projections 14 on which are mounted the dust bag flapper valve 15 and the dust bag entrance gasket and conduit 16. The dust bag gasket and conduit 16 includes a rearwardly projecting sleeve that is received in a conventional opening (not shown but indicated schematically at 17) in the dust bag 18. Dust bag 18 acts as the primary filter to trap most of the dust in the intake air.

There is a rear housing 20 which is hollowed out to receive the below described filters, fan housing and fan motor. Intermediate its length and more toward its rear, the housing has a wall 22 which spans across it. The wall 22 has a hole 24 passing through it through which the By-pass flow inlet end of the vacuum cleaner motor 114 projects, as described further below. The rear end 26 of the rear housing 20 is open. A rear cover 28 is secured to the inner wall 22 inside the housing. Spacers 32 separate the rear cover 28 and the intermediate wall 22. Bolts 44 pass through aligned holes 36 in the rear cover 28, through spacers 32 and through holes 38 in the wall 22, and into nuts 42 for fastening the rear cover 28 to the rear housing 20 and for properly spacing the cover 28 and wall 22 apart.

A sealing gasket 44 is captured inside the rear housing 20 just forward of the rear cover 28. Air inlet to the rear housing 20 is past the edges of the rear cover 28 and through the sealing gasket 44 into the open space 46 to the rear of the wall 22. The spacers 32 space the rear plate 28 sufficiently away from the rear 26 of the surrounding wall of the rear housing 20 so that entrance of air into the motor housing 114, 158 is not prevented.

The rear housing 20 has louvers 48 on its side wall forward of the dividing wall 22 to permit exhausting of fan motor cooling air from inside the rear housing 20, as described further below.

A housing sealing gasket 50 has a forward peripheral rim 52 that is captured between the front edge of the rear housing 20 and the rear edge of the front housing 10. The gasket 50 has a rearwardly extending side wall 54 that extends into the front of the rear housing 20. At the bottom of the gasket 50 on its forwardly facing side, the gasket has a cut out notch 56 for snugly receiving and positioning the below described depending plate 58 of the by-pass conduit arrangement, described below. The axial length of the gasket 50 is selected so that the plate 58 can be received at the rearward end of the notch 56 thereof and the outlet opening 138 is so placed as to overhand at the rear end of the gasket 50. The notch 56 is sufficiently deep that with the plate 58 pushed all the way rearwardly through the notch 56, the space in front of the plate 58 in the notch is filled with the flexible material sealing gasket 59.

The three housings sections 10, 50 and 20 are secured together. Snap over latch members 62 are secured on each side of the rear housing 20 by the bolts 64 being receiving in the recessed portion 66 of the rear housing 20 and aligned recessed portion 68 of the gasket 50. The latch members 62 secured to the rear housing 20 engage the catches 72 on each side wall of the front housing 10. An appropriate escutcheon plate or finishing piece 74 may be mounted on the front top portion of the front housing 10 either for carrying appropriate legends or for merely acting as a finishing piece.

A groove 76 is provided on the top, forward end of the rear housing 20. A cooperating aligned groove 78 is defined at the top of the housing gasket 50. The grooves 76, 78 receive the on-off switch operator 80 which is connected with the on-off switch 82. Through the wires 84, the switch 82 controls the operating current to the motor 114. The rear housing 20 is also provided with an integral handle 86.

Now turning to the interior of the vacuum cleaner, after the air enters the hose opening 11 at the front of the front housing 12, the air passes into the primary filter, dust collecting bag 18.

The air next travels through the air permeable, but substantially dust impermeable bag 18 through the secondary filter 90 comprised of a generally cylindrical external housing 92, in which is carried an air permeable, but particulate material impermeable filtering element 94. The cylindrical housing of the secondary filter 90 is shaped and sized so as to essentially sealingly fit into the generally narrowing cross section of the front housing 10. The primary filter dust bag 18 is folded so as to be received in the housing 10 forwardly of the secondary filter 90. The housing 92 is shaped in the manner described in part to support the entire motor and fan assembly at the proper orientation in the vacuum cleaner housing.

Positioned rearwardly of the secondary filter 90 and its housing 92 is a tertiary filter 100 in its own housing 102. The tertiary filter 100 is comprised of a fabric material layer 104, which is backed up by the grille 106 that holds the layer 104 in place. The housing 102 for the tertiary filter 100 projects rearwardly from the tertiary filter to surround the forwardly projecting collar 112 from the main fan support housing 114.

Figure 2:
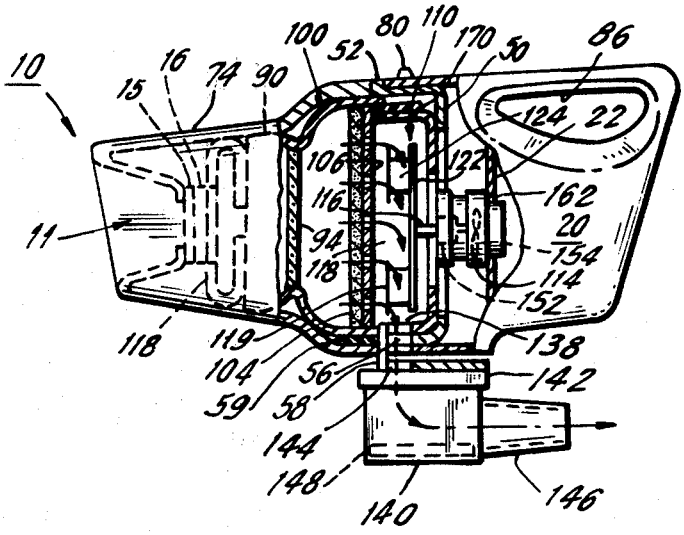
FIG. 2 is a side view, partly in cross-section, of the vacuum cleaner of FIG. 1.
Figure 3:
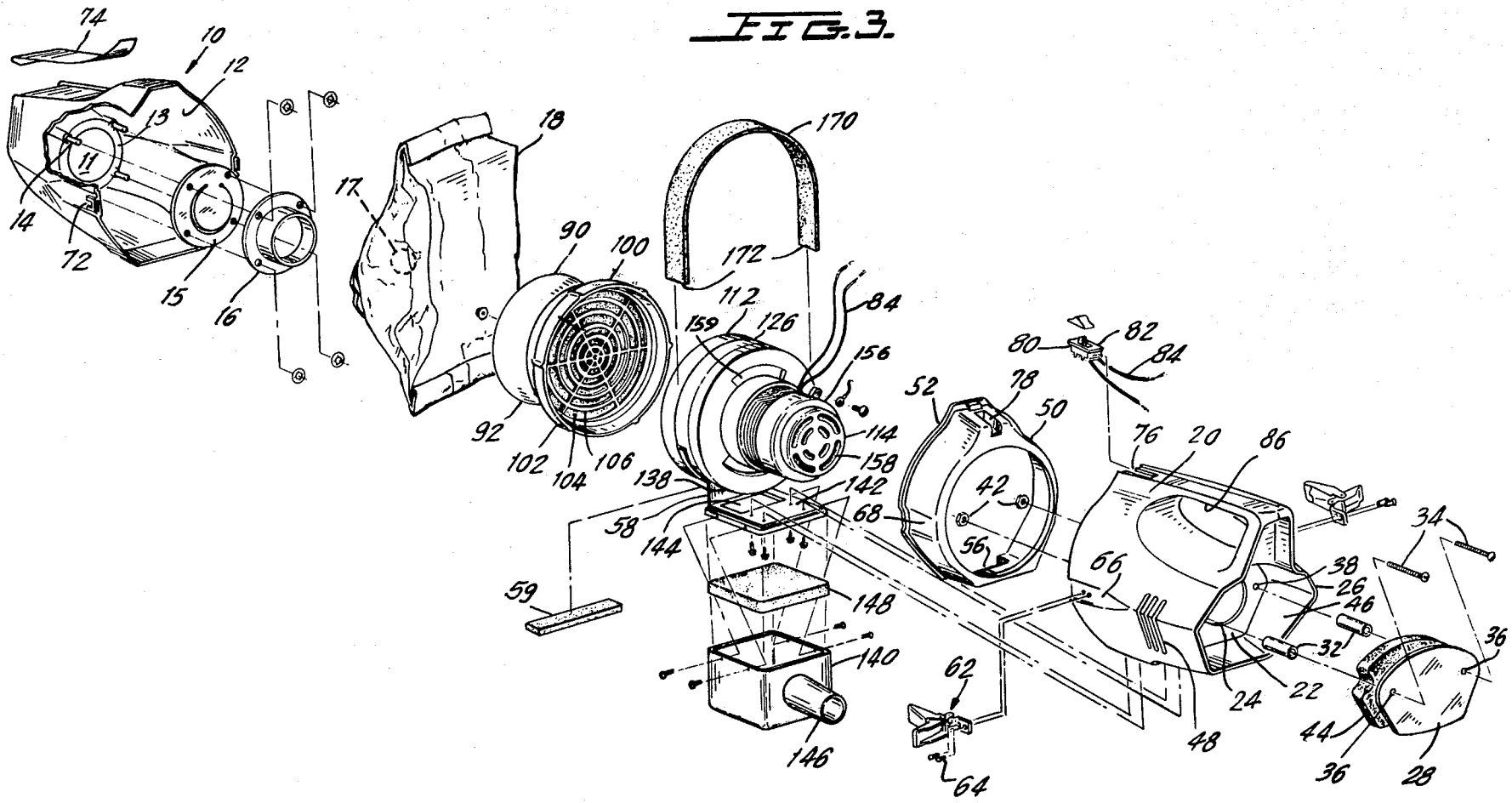
FIG. 3 is an exploded view in perspective of the vacuum cleaner of FIGS. 1 and 2.

For drawing air through the front housing 10 and the three filters described above, a fan 110 is provided. The fan is located within the housing defined by the cylinder 112. The fan 110 is driven by the below described motor 114 through the connecting shaft 116. The fan 110 is a conventional centrifugal fan which, as seen in FIGS. 2 and 3, receives its air intake axially through the forwardly facing hole 118 in the bottom disc 119 of the fan 110. The top disc 122 is spaced from the bottom disc 119. A plurality of vanes 124 extend outwardly toward the peripheries of the discs 119, 122 and rotation of the fan 110 by its shaft 116 causes the air to be sucked into the fan 110 through the hole 118 and to be discharged radially inside the fan housing 112.

The fan housing 112 has a central section 126 thereof which, as can be seen particularly from FIG. 2, is closed around its entire periphery except at its lower end where it has an arcuate discharge slit 138 therethrough through which air from the housing section 126 may be radially discharged. The discharge opening 138 from the bottom of the housing section 126 is opposed to the plenum chamber 140 which receives the air discharged through the discharge opening 138.

The plenum chamber 140 is defined at its upper end by the plenum cover 142 which is supported by the bracket arm 58 that extends down from the housing section 126. The plenum cover 142 has an entrance opening 144 therethrough, which is opposed to and aligned with the fan housing discharge opening 138.

The plenum chamber 140 essentially comprises an empty container through which the air passes. The air from the plenum chamber is exhausted through the rearwardly directed passage 146. The passage 146 is positioned beneath the bottom of the rear housing 20.

Resting on the bottom of the plenum chamber is the resilient material chamber base 148, the principal purpose of which is to act as a noise suppressor.

The motor 114 is a vacuum cleaner by-pass motor. The motor is an electric motor connected by wires 84 through switch operator 80 to a conventional power source. The by-pass motor includes the conventional electric motor portion 152 which drives the attached fan 154 the function of which is solely to cool the motor 152. The motor portion 152 also drives the main vacuum cleaner fan 110 through the shaft 116. The motor 114 includes the external housing 156 which has outlet openings 158 defined on its rearwardly facing end for allowing cooling air to enter the housing 156. The housing 156 continues down into the sealed clearance space 126, which is just beneath the housing 156. The outlet from that clearance space 126 is the crescent shaped openings 159 on the rearwardly facing wall of the housing 156. Cooling air therefore passes from the openings 158 through the housing 156 out the openings 159.

When the vacuum cleaner is assembled, the motor housing 156 is inserted partially through the opening 24 in the cross housing plate 22 up to the surface 162 on the collar around the motor housing. The collar and the opening 24 are respectively sized so that the motor 114 is fixedly positioned in the rear housing 20. The outlets 158 for the cooling air flow over the motor 114 deliver air into the space in the rear housing 20 that is forward of the separating wall 22. The shape of the housing 156 prevents the by-passing air from the being mixed with the air passing up through the main fan 102. More important, of course, the housing 156 prevents the air passing by fan 110 from mixing with the air passing through the motor 114. Additionally, the dividing wall 22 prevents any of the air that passes through the fan 110 from mixing with the cooling air that enters the motor housing 156 through the inlets 158, thereby assuring that none of the possibly explosive particulate material that is being collected by the vacuum cleaner enters the by-pass motor inlet.

For mounting the motor housing 112, 126 in the vacuum cleaner housing 10, 20, the fan housing portion 112 is received inside the collar 102 just rearward of the grille 106. At the center section 126 of the motor housing, the flexible material sealing gasket 170 is wrapped around the center section 126. The gasket 170 is of a length selected such that the ends 152 thereof extend to and halt at the arcuate ends of the outlet slit opening 138 from the center portion 126 of the fan housing. Thus, the motor and fan are sealingly supported inside the main housing 10, 20.

When the filters require change, the housing latches 62 are opened, permitting separation of the front 10 and rear 20 housings. Usually, it is only the bag 18 which must be removed and replaced. In the event that the other filters must be replaced, however, access to them is also provided. Following replacement of the filters, as quired, the housings are reconnected. In the preferred form, the entire housing 112, 126 and the motor housing 114 are supported in the rear vacuum cleaner housing 20, whereby separation of the vacuum cleaner housings 10, 20 provides easy access to the more frequently replaced filter bag 18.

In operation, air entering the front opening of the housing 10 first passes through the primary filter 18, then the secondary filter 90 and then the tertiary filter 94, passes the fan 110 and then exits through the outlet 138 through the plenum chamber 140 and through plenum chamber outlet 146. Air which has been filtered through three different filters therefore never passes over the motor 114 but instead is by-passed around the motor, thereby protecting against explosion due to any of the particulate material collected by the vacuum cleaner contacting sparks emitted by the motor.

In the separate operation described above, the vacuum cleaner motor 114 is itself cooled by the separate air flow through the rear of the rear housing 20 and out the louvers 48 at the side of the rear housing 20.

As described above, the vacuum cleaner is constructed so that it may readily be used to collect particulate material which might produce a deleterious affect if that particulate material passed over the motor of the vacuum cleaner and was affected by the sparks therein.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A vacuum cleaner, of the portable variety, or the like, comprising:

a main housing; an inlet into said main housing, said main housing inlet facing in one direction;

a filter in said housing for passing air therethrough and for trapping particulate materials thereon;

a main fan of the centrifugal type in said main housing and placed for drawing air through said main housing inlet and past said filter; said main fan having an inlet which is axial of said main housing and is placed to receive air that has been moved through said filter; said main fan having an outlet to which said main fan blows air; said outlet from said main fan is radial of said main housing;

an outlet from said main housing and communicating with said main fan outlet, whereby air is blown out of said main housing through said main housing outlet; said main housing outlet being placed radially outwardly of said fan outlet;

a chamber comprising a plenum, located outside said main housing and being in communication with said housing outlet for receiving air therefrom; an outlet from said chamber directed to blow air in a direction away from said one direction; a sound muffler in said plenum;

a motor connected with said main fan for driving said main fan; a motor cooling fan for blowing air over said motor; said motor cooling fan also being connected with said motor for being driven thereby;

a motor housing for containing said motor and said motor cooling fan; said motor housing being located in said main housing; said motor housing having an inlet through which air is drawn by said motor cooling fan for being blown over said motor; said motor housing having an outlet spaced from said motor housing inlet for outlet of air that has blown over said motor;

a divider in said main housing for dividing said main housing into separate portions such that air blown over said motor by said motor cooling fan from said motor housing inlet to said motor housing outlet does not mix in said main housing with air blown by said main fan, and such that air blown by said main fan from said main housing inlet to said main housing outlet does not blow over said motor; said motor housing outlet being at one side of said divider of said main housing, and said main fan, said main fan outlet and said main housing outlet being at the other side of said divider.

2. The vacuum cleaner of claim 1, wherein said housing is separable into forward and rearward housing sections, and the location of the separation of said housing being in the vicinity of said filter, for enabling access to said filter upon separation of said housing sections.

3. A vacuum cleaner, of the portable variety, or the like, comprising:

a main housing; an inlet into said main housing, said main housing inlet facing in one direction;

a filter in said housing for passing air therethrough and for trapping particulate materials thereon;

a main fan of the centrifugal type in said main housing and placed for drawing air through said main housing inlet and past said filter; said main fan having an inlet which is axial of said main housing and is placed to receive air that has been moved through said filter; said main fan having an outlet to which said main fan blows air; said outlet from said main fan is radial of said main housing;

an outlet from said main housing and communicating with said main fan outlet, whereby air is blown out of said main housing through said main housing outlet; said main housing outlet being placed radially outwardly of said fan outlet;

a chamber comprising a plenum, located outside said main housing and being in communication with said housing outlet for receiving air therefrom; an outlet from said chamber directed to blow air in a direction away from said one direction;

a motor connected with said main fan for driving said main fan; a motor cooling fan for blowing air over said motor; said motor cooling fan also being connected with said motor for being driven thereby;

a motor housing for containing said motor and said motor cooling fan; said motor housing being located in said main housing; said motor housing having an inlet through which air is drawn by said motor cooling fan for being blown over said motor; said motor housing having an outlet spaced from said motor housing inlet for outlet of air that has blown over said motor;

a divider in said main housing for dividing said main housing into separate portions such that air blown over said motor by said motor cooling fan from said motor housing inlet to said motor housing outlet does not mix in said main housing with air blown by said main fan, and such that air blown by said main fan from said main housing inlet to said main housing outlet does not blow over said motor; said motor housing outlet being at one side of said divider of said main housing, and said main fan, said main fan outlet and said main housing outlet being at the other side of said divider;

a second divider in said main housing placed for separating said motor housing inlet and said motor housing outlet, whereby said motor housing outlet discharges into a second chamber that is defined between the first said divider and said second divider;

a second chamber outlet from said second chamber, and said second chamber outlet being directed away from said main housing inlet.

4. The vacuum cleaner of claim 3, wherein said main housing has a second inlet, at an end of said main housing away from the first said inlet thereof, and facing away from the direction in which said main housing first inlet is facing; said main housing second inlet being into the portion of said main housing into which said motor housing inlet projects, whereby said motor cooling fan draws air over said motor, which air is taken at a location away from said first inlet to said main housing.

5. The vacuum cleaner of claim 4, wherein said housing is separable into forward and rearward housing sections, and the location of the separation of said housing being in the vicinity of said filter, for enabling access to said flter upon separation of said housing sections.

6. The vacuum cleaner of claim 5, wherein said first and said second main housing inlets are at opposite ends of said main housing and generally face in opposite directions.

* * * * *